US005386708A

United States Patent [19]

Kishorenath et al.

[11] Patent Number: 5,386,708

[45] Date of Patent: Feb. 7, 1995

[54] CRYOGENIC VACUUM PUMP WITH EXPANDER SPEED CONTROL

[75] Inventors: Huruli D. Kishorenath, San Jose; Johan E. de Rijke, Cupertino; Mark O. Foreman, Stockton, all of Calif.

[73] Assignee: Ebara Technologies Incorporated, Santa Clara, Calif.

[21] Appl. No.: 115,860

[22] Filed: Sep. 2, 1993

[51] Int. Cl.[6] ..... B01D 8/00

[52] U.S. Cl. ..... 62/55.5; 417/901

[58] Field of Search ..... 62/55.5; 419/901

[56] References Cited

U.S. PATENT DOCUMENTS

| | | | |
|---|---|---|---|
| 3,585,807 | 6/1971 | Hengevoss et al. | 62/55.5 |
| 4,285,710 | 8/1981 | Welch | 62/40 |
| 4,531,372 | 7/1985 | Slabaugh | 62/55.5 |
| 4,611,467 | 9/1986 | Peterson | 62/55.5 |
| 4,667,477 | 5/1987 | Matsuda et al. | 62/55.5 |
| 4,679,401 | 7/1987 | Lessard et al. | 62/55.5 |
| 4,757,689 | 7/1988 | Bachler et al. | 62/55.5 |
| 5,001,903 | 3/1991 | Lassard et al. | 62/55.5 |

FOREIGN PATENT DOCUMENTS

| | | | |
|---|---|---|---|
| 0004874 | 1/1986 | Japan | 62/55.5 |
| 0237275 | 10/1991 | Japan | 62/55.5 |

OTHER PUBLICATIONS

Edwards High Vacuum Int'l., "The Coolstar Series, Variable Speed, High Capacity Cryopumps and Microprocessor Controlled Compressors", Publ. No. 05-B5-26-00-895-US, 1990.

*Primary Examiner*—Ronald C. Capossela
*Attorney, Agent, or Firm*—Stanley Z. Cole

[57] ABSTRACT

Apparatus and method for vacuum pumping an enclosed chamber includes a cryogenic pumping device in fluid communication with the chamber for removing gases from the chamber. The cryogenic pumping device includes a cooled pumping surface and an expander for expanding a compressed gas and thereby cooling the pumping surface. The vacuum pumping apparatus further includes a sensor for sensing an operating parameter, such as temperature, of the cryogenic pumping device and a controller responsive to the sensor for controlling the operating speed of the expander to produce a desired value of the operating parameter. Typically, the sensor is a temperature sensor, and the controller controls the speed of the expander motor.

3 Claims, 3 Drawing Sheets

CRYOGENIC VACUUM PUMP WITH EXPANDER SPEED CONTROL

FIELD OF THE INVENTION

This invention relates to vacuum pumping of an enclosed chamber with a cryogenic vacuum pump and, more particularly, to cryogenic vacuum pumps wherein an operating parameter, such as the temperature of a cooled pumping surface, is regulated by controlling the speed of an expander motor.

BACKGROUND OF THE INVENTION

Cryogenic vacuum pumps (cryopumps) are widely used in high vacuum applications. Cryopumps are based on the principle of removing gases from a vacuum chamber by having them lose kinetic energy and then binding the gases on cold surfaces inside the pump. Cryocondensation, cryosorption and cryotrapping are the basic mechanisms that can be involved in the operation of a cryopump.

Cryopumps typically use a closed loop helium refrigerator. The refrigerator includes an expander which creates cryogenic refrigeration by the controlled expansion of compressed helium. Cryopumps typically include one or two stages. In a two stage cryopump, refrigeration is produced in a first stage operating at 50K to 80K and a second stage operating at 10K to 20K. Thermally conductive surfaces called cryoarrays are thermally connected to the stages of the expander and are cooled by them.

The refrigerator may be powered by an AC synchronous stepper motor that maintains a constant rotating speed under varying load conditions. This allows refrigeration power to remain stable when line power conditions fluctuate. The refrigerator is designed to provide maximum refrigeration at standard line power conditions.

As noted above, the cryopump can be a one stage or a two stage unit. One stage units are commonly used to condense water vapor and other gases with low vapor pressures at relatively high temperatures. Two stage units are used to remove all gases from a vacuum chamber. These gases are condensed or absorbed on thermally conductive first and second stage arrays attached to the first and second stages, respectively of the expander.

Cryopumps are commonly used in sputtering applications which involve relatively high pressures and a continuous flow of argon. In this application, the temperature of the first stage must be within certain limits for proper operation. The coldest area of the first stage should not reach temperatures below 55K-60K. If the first stage reaches a lower temperature, normally present gases such as nitrogen and argon can temporarily condense on its surface. These gases will slowly migrate to the second stage, causing a phenomenon known as nitrogen or argon "hang up". When the first stage is held at 55K-60K or higher, the first stage does not pump these gases.

In high vacuum applications of cryopumps, pumping of gases occurs primarily during an initial pumpdown period. After reaching the desired pressure, the cryopump essentially idles so as to maintain the desired pressure in the vacuum chamber. During this time, the refrigerator continues to operate at maximum power and may reduce the first stage temperature below the required level. For example, when the gas load is small, the refrigerator may reduce the first stage temperature to less than 40K, whereas 60K is sufficient. Thus refrigeration power is wasted, and "hang up" may occur.

Various approaches have been disclosed in the prior art for controlling the operating temperature of a cryopump. U.S. Pat. No. 4,667,477, issued May 26, 1987 to Matsuda et al, discloses a cryopump wherein the temperature of a cryopanel is regulated by controlling the flow rate of a gas supplied to the expander. In one embodiment, the flow rate is controlled by varying the speed of a compressor which supplies gas to the refrigerator. U.S. Pat. No. 5,001,903, issued Mar. 26, 1991 to Lessard et al, discloses a cryopump wherein the temperature of a first stage is sensed, and the sensed temperature is used to control a heater thermally connected to a second stage. The temperature of a cryopump can also be regulated by controlling the flow rate of gases received from the vacuum chamber as disclosed, for example, in U.S. Pat. No. 4,531,372 issued Jul. 30, 1985 to Slabaugh; U.S. Pat. No. 3,585,807 issued Jun. 22, 1971 to Hengevoss et al; U.S. Pat. No. 4,611,467 issued Sep. 16, 1986 to Peterson; and U.S. Pat. No. 4,285,710 issued Aug. 25, 1981 to Welch. All of the known prior art temperature regulation techniques for cryopumps have had one or more disadvantages, including imprecise temperature regulation, increased power requirements and excessive complexity.

U.S. Pat. No. 4,757,689 issued Jul. 19, 1988 to Bachler et al, discloses a cryopump wherein the pressure within the pump is sensed. When the rate of change of pressure is low, a regeneration process is automatically initiated. Temperature sensors are used to monitor and control the regeneration process.

An Edwards brochure entitled "The Coolstar series . . . variable speed, high capacity cryopumps and microprocessor controlled compressors", 1990, discloses a cryopump having a slow standby speed for extended seal life and a fast boost speed for rapid cooldown and high throughput.

SUMMARY OF THE INVENTION

According to the present invention, methods and apparatus are provided for vacuum pumping an enclosed chamber with a cryogenic pumping device. Apparatus in accordance with the invention comprises a cryogenic pumping device in fluid communication with a vacuum chamber for removing gases from the chamber, the cryogenic pumping device including a cooled pumping surface and an expander for expanding a compressed gas and thereby cooling the pumping surface, sensor means for sensing an operating parameter of the cryogenic pumping device, and control means responsive to the sensor means for controlling the operating speed of the expander to produce a desired value of the operating parameter.

The expander typically includes an expander motor, and the control means typically includes means for controlling the operating speed of the expander motor. The sensor means preferably comprises a sensor for sensing an operating temperature of the cryogenic pumping device. The control means can include means for controlling the temperature of the cooled pumping surface at or above a desired value, at or below a desired value, or within a desired range of values.

In most cases, cryogenic pumping devices include one or two pumping surfaces. In the case of a one stage unit, the control means includes means for controlling the temperature of the single pumping surface at a desired value, to insure pumping of only water vapor.

In the case of a two stage unit, the cryogenic pumping device may include a first stage pumping surface and a second stage pumping surface. The expander may include a first stage in thermal contact with the first stage pumping surface and a second stage in thermal contact with the second stage pumping surface. In a preferred application, the control means can include means for controlling the temperature of the first stage pumping surface at or above a desired value, such as about 55K–60K, to insure pumping of water vapor while avoiding argon "hang up". Optionally, means can be provided for conducting thermal energy to the first stage pumping surface for increasing the operating temperature thereof.

According to another aspect of the invention, there is provided a method for controlling the temperature of a cooled pumping surface in a cryogenic vacuum pump. The method comprises the steps of sensing the temperature of the cooled pumping surface and controlling the operating speed of the expander motor in the cryogenic vacuum pump in response to the sensed temperature to produce a desired temperature of the cooled pumping surface. In a two stage cryogenic vacuum pump, sensing the temperature of the first stage is preferred, as it has been found that changing the operating speed of the expander motor has little effect on second stage performance until very low speeds are reached.

BRIEF DESCRIPTION OF THE DRAWINGS

For a better understanding of the present invention, reference is made to the accompanying drawings which are incorporated herein by reference and in which.

DETAILED DESCRIPTION

Figure 1:
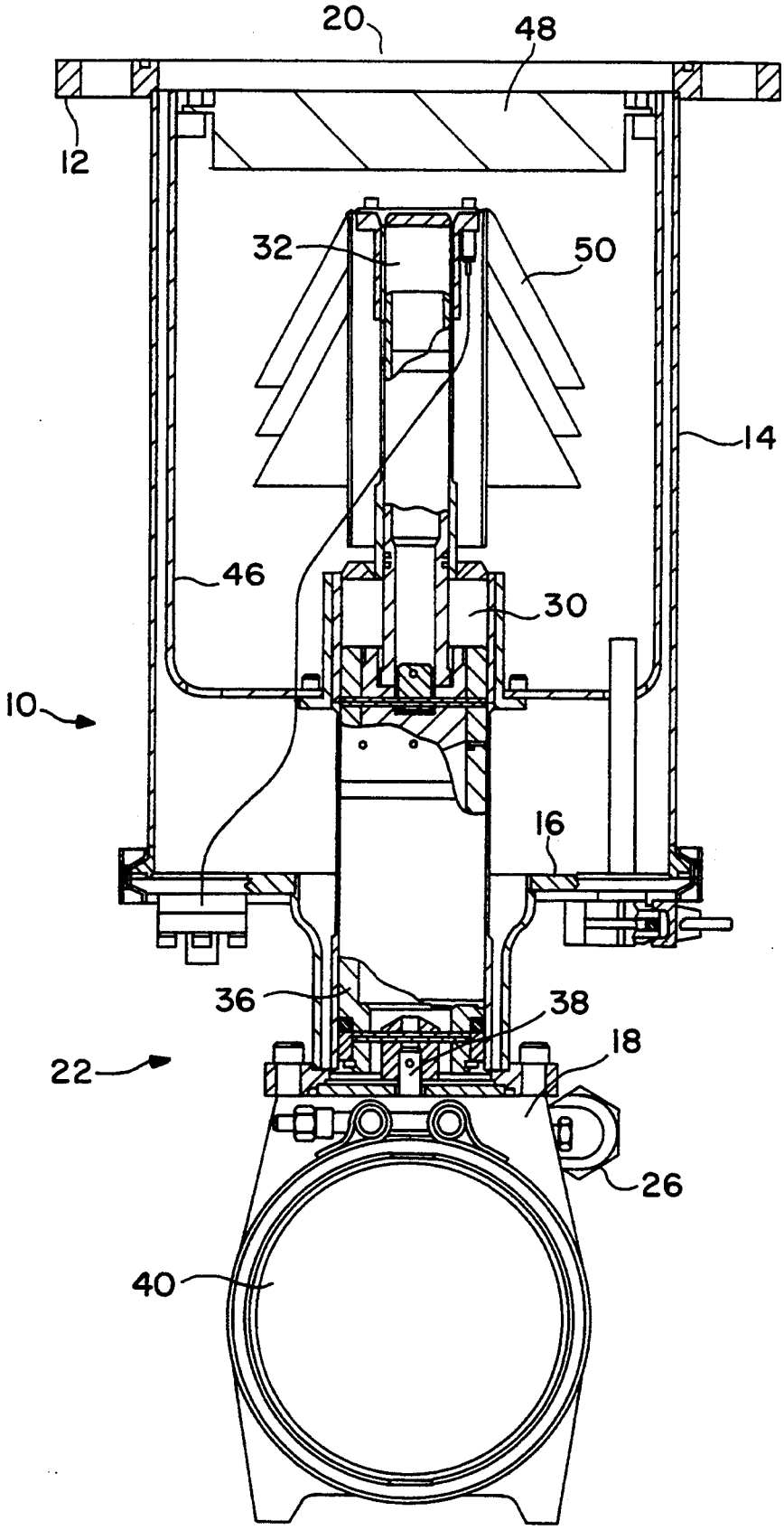
FIG. 1 is a cross-sectional view of a two stage cryogenic vacuum pump suitable for incorporation of the present invention.

A cross-sectional view of a cryopump 10 suitable for incorporation of the present invention is shown in FIG. 1. The cryopump 10 includes a flange 12 for vacuum tight connection to a vacuum chamber, not shown, typically through a vacuum valve, also not shown. The cryopump 10 removes gases from the vacuum chamber by the processes of cryocondensation and cryosorption. A housing includes a generally cylindrical wall 14 supported by a base plate 16. The base plate 16 is sealed to an expander housing 18. The flange 12 is secured to the upper end of cylindrical wall 14. The housing includes an opening 20 for receiving gases from the vacuum chamber.

The cryopump 10 includes a closed loop refrigeration system in which compressed helium gas is allowed to expand in two successive stages. In the embodiment of FIG. 1, a two stage expander 22 forms an integral part of the cryopump 10, while a compressor (not shown), in which the helium gas is compressed, is located remote from the cryopump 10. Compressed helium is received by the cryopump from the compressor through a fitting 26, and the expanded helium is exhausted through a fitting at the back of the motor housing (not shown). The first stage expansion of helium gas occurs in an expansion chamber 30 of the expander 22 and thereby causes the upper end of the expansion chamber 30 to assume a desired first stage cryogenic temperature. Typically, the first stage temperature is selected to be in a range of 55K to 80K. The second stage expansion of the helium gas occurs in an expansion chamber 32 and thereby causes the upper end of the expansion chamber 32 to assume a desired colder, second stage cryogenic temperature. Typically, the second stage temperature is selected to be in a range of 10K to 20K.

The expander 22 includes a movable element 36 which moves with a reciprocating motion in expansion chambers 30 and 32. The movable element 36 is connected by a drive rod 38 and drive mechanism to an expander motor 40. A conventional mechanical arrangement (not shown) converts rotary motion of expander motor 40 to reciprocating linear motion of drive rod 38 and movable element 36.

A first stage pumping structure is thermally and mechanically attached to the upper end of expansion chamber 30. The first stage pumping structure typically includes a cup-like, thermally conductive element 46 that extends upwardly from expansion chamber 30 and a baffle 48 mounted in the upper end of element 46. A second stage pumping structure 50 is mechanically and thermally attached to the upper end of expansion chamber 32. The second stage pumping structure is typically a cryoarray, as known in the art. The first stage pumping structure shields the pumping structure 50 from radiation from the pump housing and from direct line-of-sight radiation from the vacuum chamber.

In accordance with the present invention, the operating temperature of the cryopump 10 is controlled by controlling the operating speed of the expander 22 and, more particularly, by controlling the operating speed of the expander motor 40. The second stage pumping structure 50 or any other portion of the cryopump 10 is sensed, and the speed of the expander motor 40 is increased or decreased as necessary to provide a desired operating temperature at the region of temperature sensing. Preferably, the temperature of the first stage pumping structure 46, 48 is sensed. In principle, the temperature of the second stage pumping structure 50 can also be sensed. However, it has been found that changing the operating speed of the expander motor 40 has little effect on second stage performance until very low speeds are reached. Thus, sensing of the temperature of the first stage pumping structure is preferred.

Figure 2:
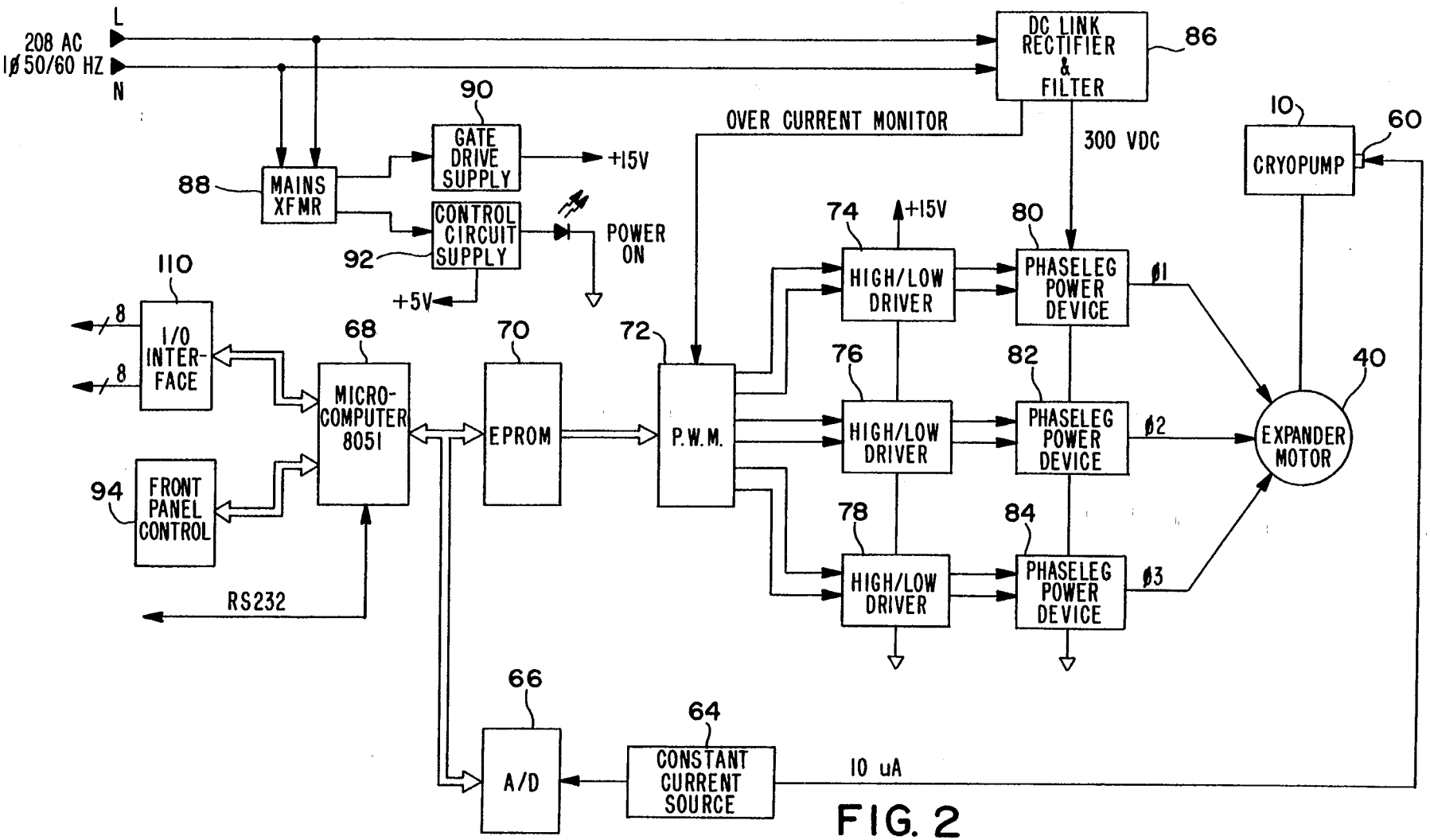
FIG. 2 is a block diagram of a control system for controlling expander speed in accordance with the present invention.

A block diagram of a vacuum pumping system, including feedback control of expander motor speed, is shown in FIG. 2. In FIG. 2, the expander motor 40 is shown separate from cryopump 10 for ease of understanding. However, it will be understood that the expander motor 40 is part of the cryopump 10 as shown in FIG. 1 and described above.

A temperature sensor 60 is shown schematically attached to the cryopump 10 in FIG. 2. The temperature sensor 60 can be attached to any desired portion of the cryopump, but is typically attached to the first stage pumping structure 46, 48. In a preferred embodiment, the temperature sensor 60 is a silicon diode biased at a current of about 10 microamps by a constant current source 64. Changes in temperature cause a change in diode voltage.

The diode voltage is converted by an analog-to-digital converter 66 to a digital value, and the digital value is supplied to a microprocessor 68. The microprocessor 68 can, for example, be a type 8051 manufactured by Intel. The microprocessor 68 compares the sensed temperature with one or more threshold values which define a desired operating temperature range and determines whether the operating speed of expander motor 40 must be increased or decreased in order to bring the temperature within the desired range.

Suitable control signals are stored in an EPROM 70. When an increase or decrease in the speed of expander motor 40 is required, the microprocessor 68 addresses an appropriate location in EPROM 70, which in turn provides control signals to a pulse width modulator 72. The pulse width modulator 72 can, for example, be a type MD828-1 manufactured by Plessy. The pulse width modulator 72 generates controlled frequency signals for driving expander motor 40. In a preferred embodiment, the expander motor is a three phase asynchronous stepper motor, such as a type SS422 manufactured by Superior Electric. The outputs of the pulse width modulator 72 are supplied through logic drivers 74, 76 and 78 and power drivers 80, 82 and 84 to the three phase inputs of expander motor 40. In a preferred embodiment, the power drivers 80, 82 and 84 switch 300 volts DC generated by a power supply 86. The speed of expander motor 40 is controlled by varying the frequency of the pulses supplied by power drivers 80, 82 and 84. In the above example, the expander motor 40 is preferably controlled in a range of 30 RPM to 90 RPM.

The controller also includes a transformer 88, a power supply 90 for logic drivers 74, 76 and 78 and a power supply 92 for the low voltage digital circuitry in the controller. An overcurrent signal is provided by power supply 86 to pulse width modulator 72. In the event of an overcurrent condition, the pulse width modulator 72 deenergizes the expander motor 40. An I/O interface 110 connected to microprocessor 68 can be used for diagnostic testing of the controller or for any other desired communication with the cryopump controller.

Figure 3:
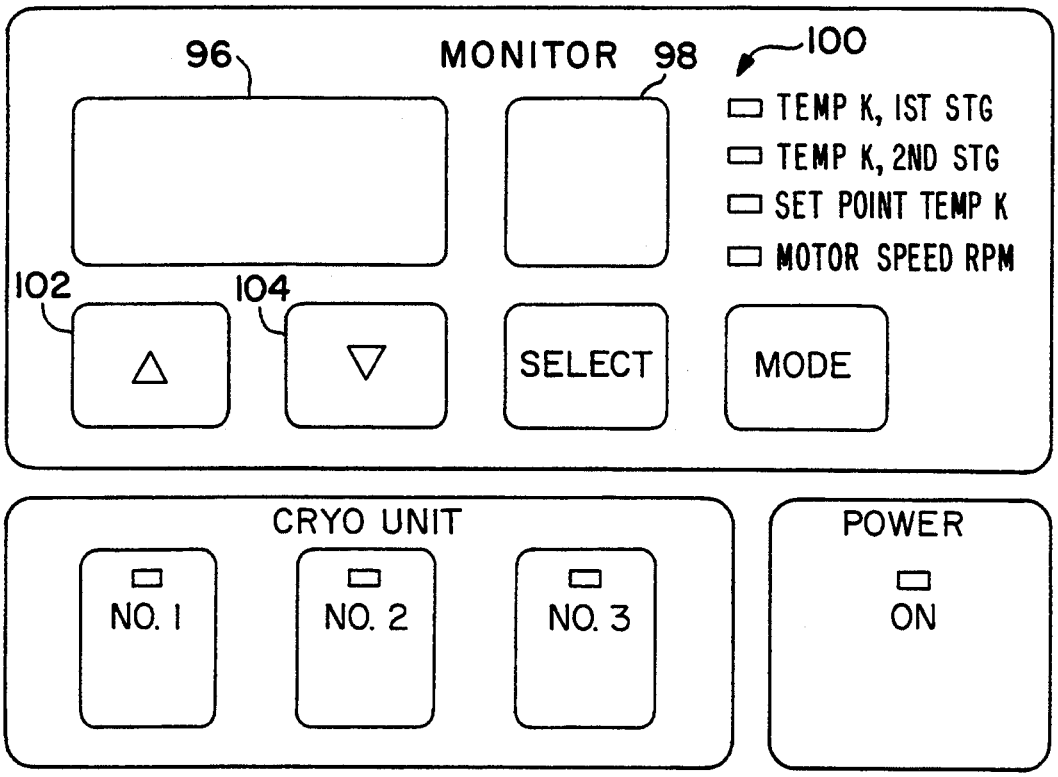
FIG. 3 shows the operator control in the control system of FIG. 2.

The microprocessor 68 communicates with a front panel 94 as shown in FIG. 3. The front panel includes numeric displays 96 and 98, indicator LED's 100 and keys for operator selection. In the example of FIG. 3, the controller is used to control three different cryopumps. However, it will be understood that the controller can be utilized with any desired number of cryopumps. The display 96 can be used to display the actual temperature of the first or second stage, the set point temperature or the speed of expander motor 40. The keys 102 and 104 are used to increase or decrease the set point temperature. The controller then regulates the expander motor 40 speed to maintain the set point temperature as described above.

The controller can be utilized to control any desired operating temperature within the cryopump 10. In general, it will be understood that the controller can be used to regulate the temperature of a desired region of the cryopump using an upper temperature limit, a lower temperature limit, or both. Examples of preferred applications will now be given.

In a first example, the cryopump is used in a sputtering application and typically receives a continuous flow of argon. In this example, it is desirable to maintain the coldest temperature of the first stage at a temperature which will pump water vapor but not argon, in order to avoid argon "hang up". This typically requires a temperature of 55K–60K or greater. Thus, a set point of 55K–60K can be utilized. If the first stage temperature goes below 55K–60K, the speed of the expander motor 40 is decreased. As a result, the cooling provided by expander 22 decreases, and the temperature of the first stage increases to or above the required set point. Also, if the temperature of the first stage increases above the required set point as a result of a heat load or a gas load, the speed of the expander motor 40 is increased, thereby increasing the refrigeration power and maintaining the first stage temperature within the desired range. Since the first stage temperature tends to vary more widely than the second stage temperature, overall pump performance is improved by sensing the first stage temperature. The improved cryopump performance described above is particularly advantageous in the processing of semiconductor wafers having microminiature devices fabricated thereon.

In a second example, the control technique of the present invention is used to control a single stage cryopump utilized for pumping only water vapor. In this example, the temperature of the single stage pump is regulated at approximately 123K to ensure only pumping of water vapor, while avoiding pumping of other gases. By regulating the temperature of the single stage cryopump at approximately 123K, pumping of other gases, such as carbon dioxide, which may occur at temperatures of 100K or lower, is avoided.

In accordance with a further feature of the invention, means, such as a heater or a passive thermal shunt, can optionally be provided for supplying thermal energy to the first stage of cryopump 10. This feature may be useful to control the relative refrigeration power levels of the first and second stages. For example, when the first stage is regulated at a desired temperature as described above, the refrigerator may supply insufficient refrigeration power to maintain a desired second stage temperature. By supplying thermal energy to the first stage with a passive thermal shunt or a heater, the refrigeration power required to maintain the first stage temperature is increased, and the second stage refrigeration power is also increased.

The cryopump 10 shown in FIG. 1 and described above has two stages. It will be understood that the present invention can be utilized with single stage and two stage cryopumps, and more generally with any cryopump having an expander that is subject to expander speed control. The invention is not limited to cryopumps of the type shown in FIG. 1.

Another advantage of the present invention is that natural mechanical resonances of the equipment in which the cryopump is installed can be avoided by controlling the operating speed of the expander motor. If the expander motor operates at a fixed frequency that is at or near a resonance frequency of the equipment, vibrations of the expander 22 may be amplified. By avoiding the natural resonance frequency of the equipment, such vibrations can be suppressed. Specifically, the microprocessor 68 and the EPROM 70 can be programmed to avoid operating the expander motor 40 in a range of frequencies near the natural resonance frequency of the equipment. In most cases, expander speed regulation can be used to improve cryopump performance, while avoiding such natural resonance frequencies.

While there have been shown and described what are at the present considered the preferred embodiments of the present invention, it will be obvious to those skilled in the art that various changes and modifications may be made therein without departing from the scope of the invention as defined by the appended claims.

What is claimed is:

1. Apparatus with suppressed vibrations, for vacuum pumping one or more selected gaseous components of an enclosed chamber, comprising:

a cryogenic pumping device in fluid communication with said chamber for removing gases from the chamber, said cryogenic pumping device including a cooled pumping surface, cooled to a preselected temperature to selectively remove by cryocondensation gases which are condensed at said temperature;

an expander for expanding a compressed gas and thereby cooling said pumping surface, said expander including an expander motor having an operating speed;

a temperature sensor for sensing the temperature of said cooled pumping surface; and control means programmed to operate the expander motor in an operational range of frequencies different from the natural resonance frequencies of said apparatus to suppress vibrations of such apparatus as compared to operation of said expander motor at said resonance frequencies, said control means also being responsive to the sensed temperature of said cooled first stage pumping surface for controlling the operating speed of said expander motor in said operational range of frequencies to produce said preselected temperature at said cooled pumping surface.

2. Apparatus for vacuum pumping an enclosed chamber, comprising:

a cryogenic pumping device in fluid communication with said chamber for removing gases from said chamber, said cryogenic pumping device including a first stage pumping surface and a second stage pumping surface;

an expander for expanding compressed gas in thermal contact with said first stage pumping surface to cool said first stage pumping surface, said expander having an expander motor having an operating speed;

a temperature sensor for sensing the temperature of said cooled first stage pumping surface;

control means programmed to set said expander motor at an operating speed which is different from the natural resonance frequencies of said apparatus to suppress vibrations of such apparatus as compared to operation of said expander motor at frequencies including said resonance frequencies, said control means also being responsive to the sensed temperature of said cooled first stage pumping surface for controlling the operating speed of said expander motor to produce at said operating speed of said expander motor a desired temperature at said cooled pumping surface; and means for conducting thermal energy to said first stage pumping surface for increasing the operating temperature thereof.

3. The method of cooling the second stage of a two stage cryogenic pump to a disproportionately low temperature as compared to the temperature to which the first stage is cooled, comprising;

preselecting a temperature for operation of the first stage of said cryogenic pump;

controlling means responsive to the sensed temperature of said cooled first stage pumping surface for controlling the operating speed of an expander motor in a range of frequencies different from the natural resonance frequencies of said cryopump to suppressing vibrations of said pump as compared to operating said expander motor at frequencies including said resonance frequencies while cooling said first stage toward said preselected temperature at said cooled first stage pumping surface;

cooling a second pumping surface in said second stage of said pump by expanding a compressed gas in thermal contact with said second pumping surface, said pumping system causing a preset temperature relationship between the coolness of the second pumping surface and the coolness of said first pumping surface;

sensing the temperature of said first pumping surface to set the operating speed of the expander motor within said range of frequencies to achieve, with suppressed vibrations, a desired temperature at said first pumping surface; and supplying thermal energy to said first pumping surface, thereby increasing the refrigeration power of said expander motor in cooling said first and second pumping surfaces to lower temperatures.

* * * * *